US007281401B2

(12) United States Patent
Shen

(10) Patent No.: US 7,281,401 B2
(45) Date of Patent: Oct. 16, 2007

(54) PROTECTIVE SLEEVE FOR LATCH MECHANISM FOR LOCK

(75) Inventor: Mu-Lin Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 11/307,456

(22) Filed: Feb. 8, 2006

(65) Prior Publication Data

US 2007/0180876 A1 Aug. 9, 2007

(51) Int. Cl.
*E05B 9/04* (2006.01)

(52) U.S. Cl. ..... 70/449; 70/416; 70/451; 70/134; 70/107; 292/356

(58) Field of Classification Search ..... 70/449, 70/134, 416, 417, 452, 451, 107; 292/356, 292/357

See application file for complete search history.

(56) References Cited

U.S. PATENT DOCUMENTS 1,661,454 A * 3/1928 Wilson ..... 70/448
1,701,994 A * 2/1929 Wilson ..... 292/169.18
1,719,282 A * 7/1929 Wilson ..... 70/153
1,724,630 A * 8/1929 Wilson ..... 292/169.21
2,879,096 A * 3/1959 McConnell ..... 292/169.22
3,621,685 A * 11/1971 Wilson ..... 70/107
4,109,498 A * 8/1978 Dietrich ..... 70/449
4,272,974 A * 6/1981 Hennessy ..... 70/129
4,338,804 A * 7/1982 Solovieff ..... 70/134
5,335,950 A * 8/1994 Mirshafiee et al. ..... 292/356

* cited by examiner

*Primary Examiner*—Suzanne Dino Barrett
(74) *Attorney, Agent, or Firm*—Alan Kamrath; Kamrath & Associates PA

(57) ABSTRACT

A protective sleeve for a lock includes a circumferential wall delimiting a longitudinal through-hole. The circumferential wall includes at least one longitudinal slot, forming at least one shielding skirt for shielding a housing of a latch mechanism of a lock that extends into the protective sleeve via the longitudinal slot. A tab extends from a perimeter delimiting the longitudinal slot into the longitudinal through-hole of the protective sleeve. The tab is extended through by an associated mounting post of the lock. A lock with such a protective sleeve is also disclosed.

10 Claims, 5 Drawing Sheets

PROTECTIVE SLEEVE FOR LATCH MECHANISM FOR LOCK

BACKGROUND OF THE INVENTION

1. Field of the Invention

The present invention relates to a protective sleeve for a lock and, more particular1y, to a protective sleeve for a latch mechanism for a lock. The present invention also relates to a lock with such a protective sleeve.

2. Description of the Related Art

FIG. 1 of the drawings illustrates a conventional tubular lock comprising an inner assembly 1, an outer assembly 2, and a latch mechanism 3. The inner assembly 1 comprises an inside handle 11, an inside spindle 13 securely coupled to the inside handle 11 to turn therewith, and an inside rose 12. The inside spindle 13 is coupled to a center of an inside supporting plate 14. The outer assembly 2 comprises an outside handle 21, an outside spindle 23 securely coupled to the outside handle 21 to turn therewith, and an outside rose 22. Two mounting posts 25 extend from a side of an outside supporting plate 24 that has a center to which the outside spindle 23 is securely coupled. Fasteners 16 such as screws are extended through through-holes 15 in the inside supporting plate 14 into screw holes 251 in the mounting posts 25 to thereby secure the inside supporting plate 14 and the outside supporting plate 24 together.

The latch mechanism 3 comprises a housing 32 in which a wheel 33 is rotatably mounted, a casing 31 mounted around a front end of the housing 32, and a latch 34 operably connected to the wheel 33. The outside spindle 23 includes a square tube 231 extending through a square hole 331 of the wheel 33 and coupled with the inside spindle 13 such that rotation of either handle 11, 21 turns the wheel 33 and, thus, retracts the latch 34.

Wood or iron dusts are generated while drilling a mounting hole in a door and a compartment in an edge of the door for installing the tubular lock. The residual dusts in the mounting hole and/or the compartment of the door might enter the latch mechanism 3 during installation of the lock or when the door vibrates due to opening or closing of the door. Operation of the latch 34 could thus be adversely affected.

BRIEF SUMMARY OF THE INVENTION

An objective of the present invention is to provide a protective sleeve for a housing of a latch mechanism of a lock.

Another objective of the present invention is to provide a lock with a protective sleeve to shield the housing of the latch mechanism of the lock.

In accordance with a first aspect of the present invention, a protective sleeve for a lock comprises a circumferential wall delimiting a longitudinal through-hole. The circumferential wall comprises at least one longitudinal slot, forming at least one shielding skirt adapted for shielding a housing of a latch mechanism of a lock that extends into the protective sleeve via the at least one longitudinal slot. A tab extends from a perimeter delimiting the at least one longitudinal slot into the longitudinal through-hole of the protective sleeve. The tab is adapted to be extended through by a mounting post of the lock.

Preferably, the circumferential wall of the protective sleeve is adapted to be fittingly received in a mounting hole of a door to which the lock is mounted.

Preferably, the protective sleeve has a longitudinal length slightly smaller than that of a mounting hole of a door to which the lock is mounted.

Preferably, the tab includes a through-hole adapted to be extended through by a mounting post of the lock.

In accordance with a second aspect of the present invention, a protective sleeve for a lock comprises a circumferential wall delimiting a longitudinal through-hole. The circumferential wall comprises two diametrically opposed longitudinal slots, forming two diametrically opposed shielding skirts adapted for shielding a housing of a latch mechanism of a lock that extends into the protective sleeve via one of the longitudinal slots. A tab extends from a perimeter delimiting each longitudinal slot into the longitudinal through-hole of the protective sleeve. Each tab includes a through-hole adapted to be extended through by an associated one of two mounting posts of the lock.

In accordance with a third aspect of the present invention, a lock comprises a latch mechanism, an inner assembly, an outer assembly, and a protective sleeve. The latch mechanism comprises a housing and a latch. A wheel is rotatably mounted in the housing and operably connected to the latch. The inner assembly comprises an inside handle, an inside spindle coupled to the inside handle to turn therewith, and an inner supporting plate to which the inside spindle is securely mounted. The outer assembly comprises an outside handle, an outside spindle coupled to the outside handle to turn therewith, an outer supporting plate to which the outside spindle is securely mounted, and two mounting posts extending from the outer supporting plate and each including a screw hole. The outside spindle comprises a square tube extending through the wheel for retracting the latch.

The protective sleeve comprises a circumferential wall delimiting a longitudinal through-hole. The circumferential wall comprises two diametrically opposed longitudinal slots, forming two diametrically opposed shielding skirts for shielding the housing that extends into the protective sleeve via one of the longitudinal slots. A tab extends from a perimeter delimiting each longitudinal slot into the longitudinal through-hole of the protective sleeve. Each tab includes a through-hole through which an associated one of the mounting posts extends. Two fasteners extend through the inside supporting plate into the screw holes of the mounting posts.

Other objectives, advantages, and novel features of the invention will become more apparent from the following detailed description when taken in conjunction with the accompanying drawings.

DETAILED DESCRIPTION OF THE INVENTION

Figure 1:
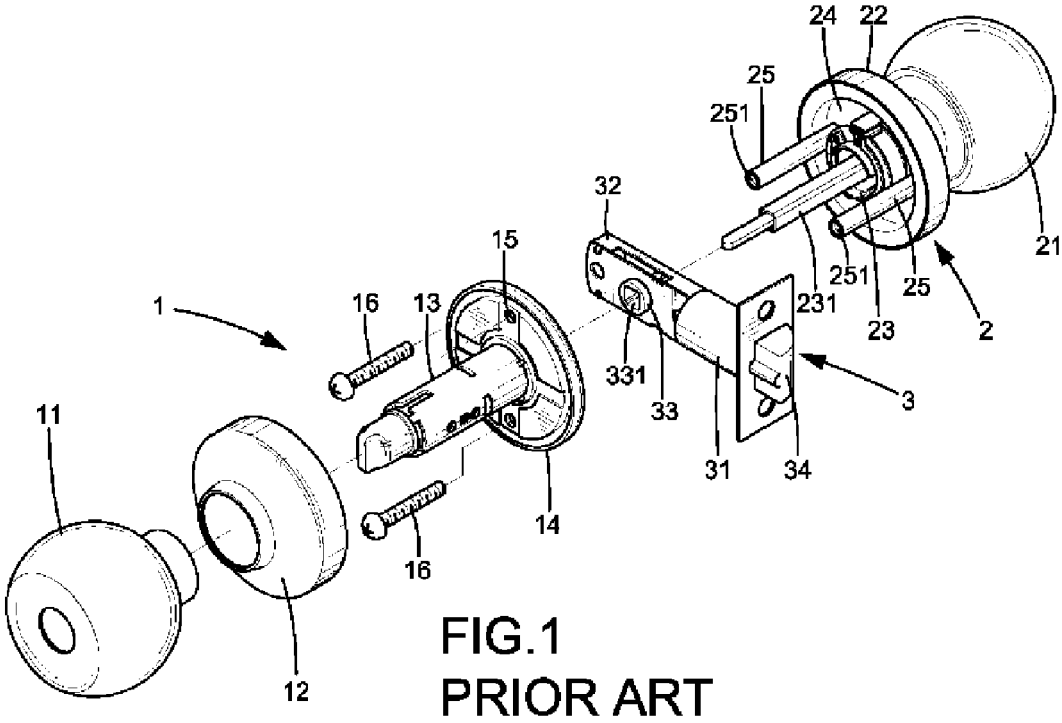
FIG.1 PRIOR ART
FIG. 1 is an exploded perspective view of a conventional tubular lock.
Figure 2:
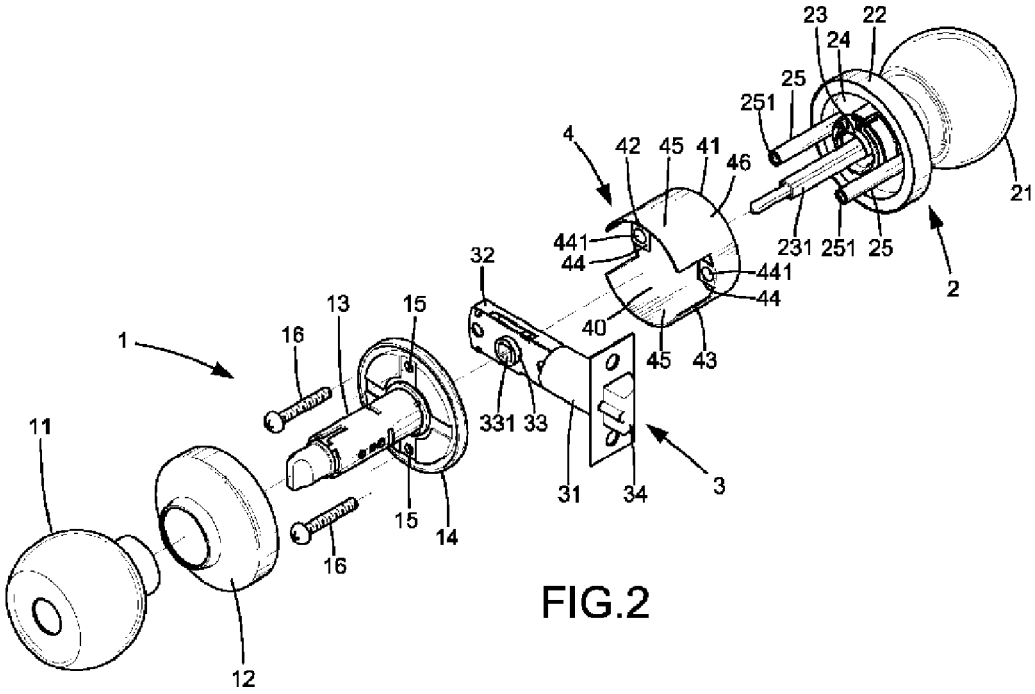
FIG. 2 is an exploded perspective view of a tubular lock in accordance with the present invention.

FIG. 2 illustrates a lock with a protective sleeve 4 in accordance with the present invention. The lock in the illustrated example is a tubular lock. Nevertheless, it is noted that the protective sleeve 4 is not limited to be used with a tubular lock.

Referring to FIG. 2, the lock in this example comprises an inner assembly 1, an outer assembly 2, and a latch mechanism 3. The elements of the tubular lock in accordance with the present invention similar to those of the conventional one are labeled with same reference numbers without any limiting intention.

The inner assembly 1 comprises an inside handle 11, an inside spindle 13 securely coupled to the inside handle 11 to turn therewith, and an inside rose 12. The inside spindle 13 is coupled to a center of an inside supporting plate 14. The outer assembly 2 comprises an outside handle 21, an outside spindle 23 securely coupled to the outside handle 21 to turn therewith, and an outside rose 22. Two mounting posts 25 extend from a side of an outside supporting plate 24 that has a center to which the outside spindle 23 is securely coupled. Fasteners 16 such as screws are extended through through-holes 15 in the inside supporting plate 14 into screw holes 251 in the mounting posts 25 to thereby secure the inside supporting plate 14 and the outside supporting plate 24 together.

Figure 3:
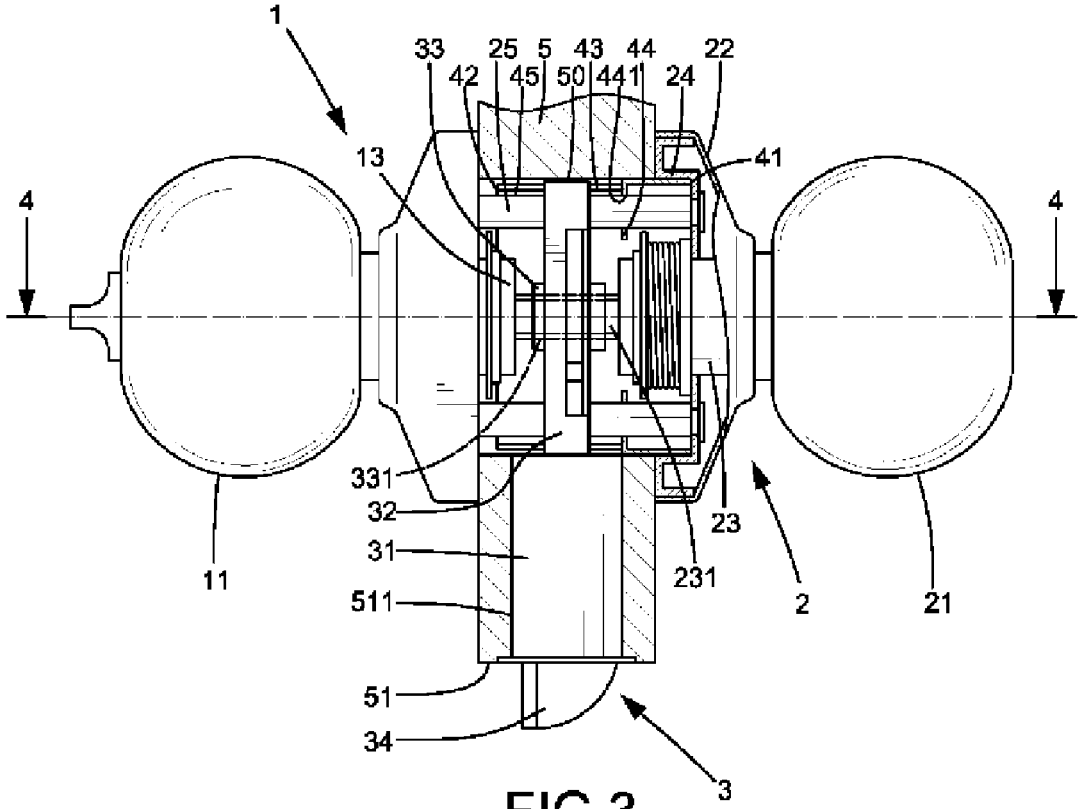
FIG. 3 is a sectional of the tubular lock in FIG. 2 and a door to which the tubular lock is mounted.
Figure 4:
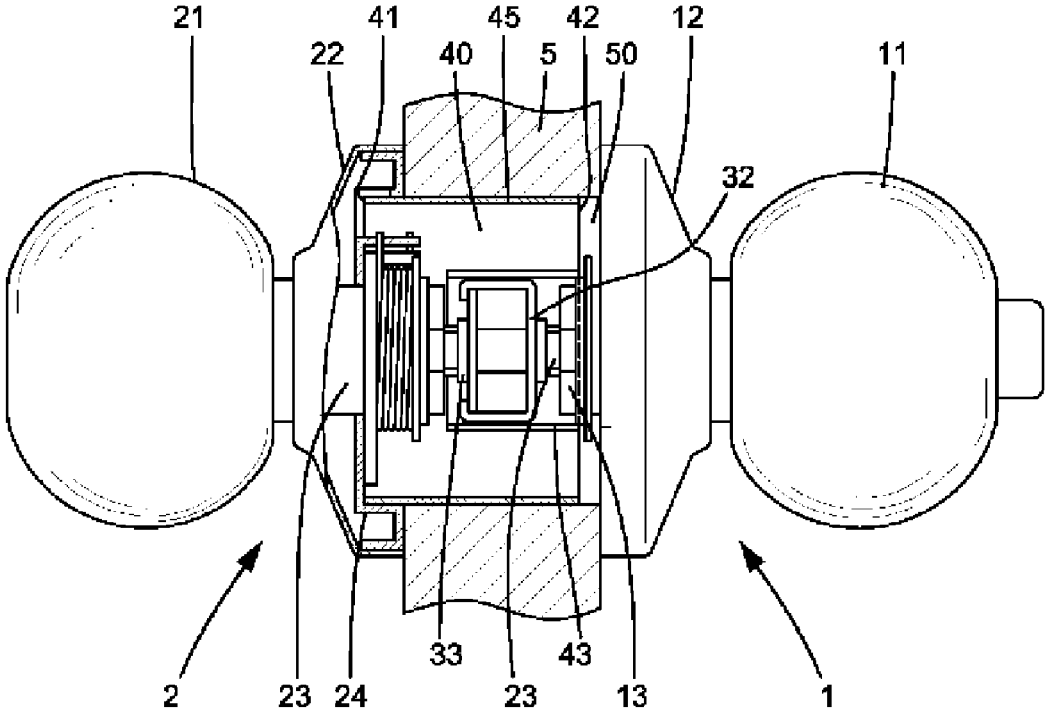
FIG. 4 is a sectional view taken along plane 4-4 in FIG. 3.

The latch mechanism 3 is mounted in a compartment 511 (FIG. 3) in an edge 51 of a door 5 to which the tubular lock is mounted. Referring to FIGS. 3 and 4, the door 5 further includes a mounting hole 50 into which the inner assembly 1 and the outer assembly 2 are mounted.

The latch mechanism 3 comprises a housing 32 in which a wheel 33 is rotatably mounted, a casing 31 mounted around a front end of the housing 32, and a latch 34 operably connected to the wheel 33. The outside spindle 23 includes a square tube 231 extending through a square hole 331 of the wheel 33 and coupled with the inside spindle 13 such that rotation of either handle 11, 21 turns the wheel 33 and, thus, retracts the latch 34.

Referring to FIGS. 2 through 5, the lock in accordance with the present invention further comprises a protective sleeve 4 for shielding the housing 32 and, thus, for preventing dusts from entering the housing 32 of the latch mechanism 3. The protective sleeve 4 comprises a longitudinal hole 40 delimited by a circumferential wall 46. An outer diameter of the protective sleeve 4 is preferably equal to an inner diameter of the mounting hale 50 of the door 5, allowing the circumferential wall 46 of the protective sleeve 4 to be fittingly received in the mounting hole 50 of the door 5. The protective sleeve 4 includes a first end 41 for receiving the outer supporting plate 24 and a second end 42. A longitudinal length of the protective sleeve 4 is preferably slightly smaller than that of the mounting hole 50 of the door 5.

The second end 42 of the protective sleeve 4 further comprises two spaced longitudinal slots 43 extending along the longitudinal direction of the protective sleeve 4, forming at least one shielding section or skirt 45. Preferably, the longitudinal slots 43 are diametrically opposed, and two diametrically opposed shielding skirts 45 are formed. A tab 44 extends radially inward from a perimeter delimiting each longitudinal slot 43 into the longitudinal hole 40 of the protective sleeve 4. Each tab 44 has a through-hole 441 through which an associated one of the mounting posts 25 extends. Each slot 43 has a width and a length large enough for accommodating the housing 32 of the latch mechanism 3.

Figure 5:
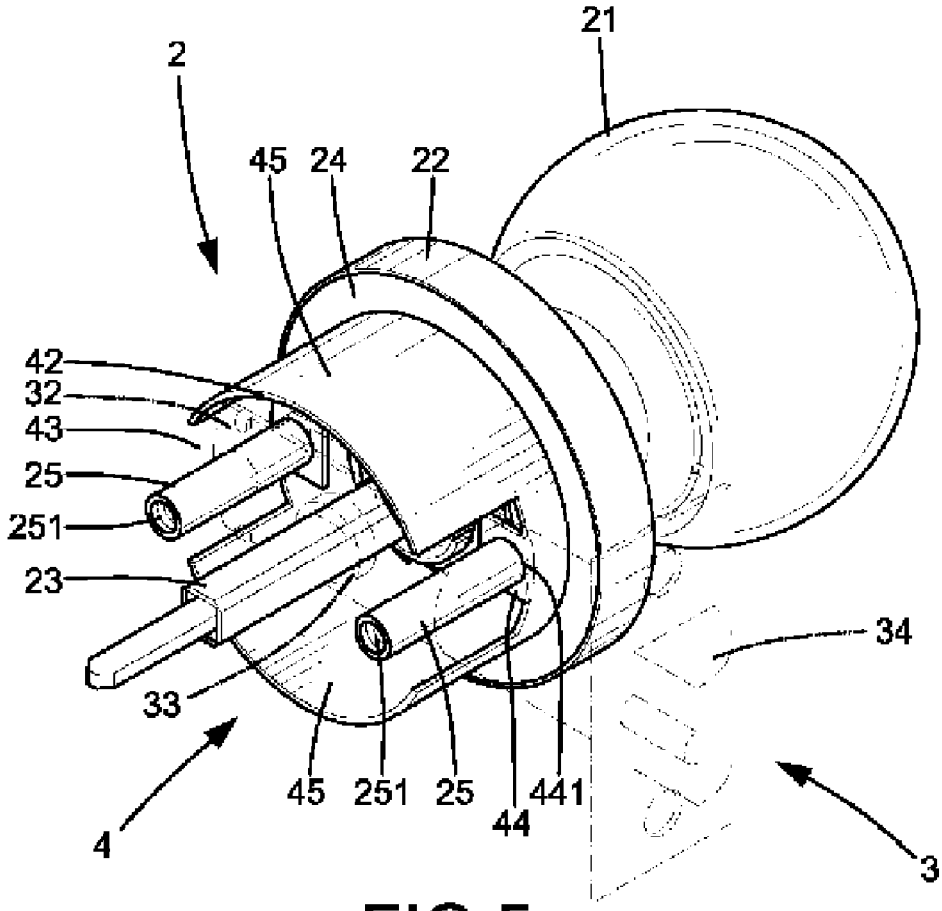
FIG. 5 is a perspective view illustrating an outer assembly and a protective sleeve of the tubular lock in FIG. 2.

Referring to FIGS. 4 and 5, in assembly, the mounting posts 25 are respectively extended through the through-holes 441 of the tabs 44. The first end 41 of the protective sleeve 4 is thus mounted inside the outer supporting plate 24 of the outer assembly 2. The second end 42 of the protective sleeve 4 is inserted into the mounting hole 50 of the door 5, with the longitudinal slots 43 of the protective sleeve 4 aligned with the housing 32 of the latch mechanism 3. Then, the fasteners 16 are extended through the through-holes 15 of the inner supporting plate 15 into the screw holes 251 of the mounting posts 25, thereby connecting the inner supporting plate 14, the latch mechanism 3, and the outer supporting plate 24 together. It is noted that the circumferential wall of the protective sleeve 4 is preferably in contact with an inner circumferential wall delimiting the mounting hole 50 of the door 5. Further, the housing 32 merely extends through one of the longitudinal slots 43, as shown in FIG. 3. Nevertheless, provision of a pair of longitudinal slots 43 allows easy assembly of the protective sleeve 4, the mounting posts 25, and the housing 32 of the latch mechanism 3.

Still referring to FIG. 4, the shielding skirts 45 cover the housing 32 of the latch mechanism 3. Hence, when residual wood dusts or metal scraps in the mounting hole 50 or the compartment 511 of the door 5 fall, the shielding skirts 45 shield the housing 32 from the dusts. The elements housed in the housing 32 are thus protected. Smooth operation of the latch mechanism 3 is assured, and the life of the latch mechanism 3 is prolonged. The longitudinal length of the shielding skirts 45 of the protective sleeve 4 is sufficiently long to allow the protective sleeve 4 to be mounted in doors 5 of various thicknesses for protecting the housing 32 of the latch mechanism 3.

The protective sleeve 4 is detachably mounted to the outer assembly 2 in a convenient manner. After assembly, the protective sleeve 4 provides improved engaging strength for the lock and the door 5. As illustrated in FIGS. 3 and 4, the first end 41 of the protective sleeve 4 is located in the outer supporting plate 24 and the second end 42 of the protective sleeve 4 is located in the mounting hole 50 of the door 5. Hence, the engaging strength between the outer assembly 2 and the door 5 is enhanced by the protective sleeve 4. The structural strength of the lock in accordance with the present invention is improved accordingly.

Although a specific embodiment has been illustrated and described, numerous modifications and variations are still possible without departing from the essence of the invention. The scope of the invention is limited by the accompanying claims.

What is claimed is:

1. A protective sleeve for a lock, the protective sleeve comprising a circumferential wall having a first open end and a second open end and delimiting a longitudinal through-hole between the first open end and the second open end, with the circumferential wall having a constant thickness between the first and second open ends and around a circumference thereof, with the circumferential wall comprising at least one longitudinal slot extending from the second open end towards but spaced from the first open end, with the at least one longitudinal slot including first and second side edges extending from the second open end and toward but spaced from the first open end and a terminal edge extending between the first and second side edges and located intermediate the first and second open ends, with the first and second side edges and the terminal edge defining a perimeter delimiting the at least one longitudinal slot, with the at least one longitudinal slot forming at least one shielding skirt adapted for shielding a housing of a latch mechanism of a lock that extends into the protective sleeve through said at least one longitudinal slot, with the circumferential wall further comprising a tab extending from the perimeter delimiting said at least one longitudinal slot and spaced from the first open end and the second open end and into the longitudinal through-hole of the circumferential wall, with the tab bent from the circumferential wall at the terminal edge of the perimeter delimiting the at least one longitudinal slot, with the tab having a thickness equal to the constant thickness, with the tab being adapted to receive a mounting post of the lock.

2. The protective sleeve for a lock as claimed in 1, with the circumferential wall of the protective sleeve being adapted to be fittingly received in a mounting hole of a door to which the lock is mounted.

3. The protective sleeve for a lock as claimed in claim 1, with the circumferential wall having a longitudinal length between the first and second open ends slightly smaller than that of a mounting hole of a door to which the lock is mounted.

4. The protective sleeve for a lock as claimed in claim 1, with the tab including a through-hole adapted to receive the mounting post of the lock.

5. A protective sleeve for a lock, the protective sleeve comprising a circumferential wall having a first open end and a second open end and delimiting a longitudinal through-hole extending between the first open end and the second open end, with the circumferential wall having a constant thickness between the first and second open ends and around a circumference thereof, with the circumferential wall comprising two diametrically opposed longitudinal slots each extending from the second open end towards but spaced from the first open end, with the two diametrically opposed longitudinal slots each including first and second side edges extending from the second open end and toward but spaced from the first open end and a terminal edge extending between the first and second side edges and located intermediate the first and second open ends, with the first and second side edges and the terminal edge defining a perimeter delimiting the longitudinal slot, with the two diametrically opposed longitudinal slots forming two diametrically opposed shielding skirts adapted for shielding a housing of a latch mechanism of a lock that extends into the protective sleeve through one of the longitudinal slots, with the circumferential wall further comprising a tab extending from the perimeter delimiting each said longitudinal slot and spaced from the first open end and the second open end and into the longitudinal through-hole of the circumferential wall, with the tab bent from the circumferential wall at the terminal edge of the perimeter delimiting each said longitudinal slot, with each said tab having a thickness equal to the constant thickness, with each said tab including a through-hole adapted to receive an associated one of two mounting posts of the lock.

6. The protective sleeve for a lock as claimed in claim 5, with the circumferential wall of the protective sleeve being adapted to be fittingly received in a mounting hole of a door to which the lock is mounted.

7. The protective sleeve for a lock as claimed in claim 5, with the circumferential wall having a longitudinal length between the first and second open ends slightly smaller than that of a mounting hole of a door to which the lock is mounted.

8. A lock comprising:

a latch mechanism comprising a housing and a latch, a wheel being rotatably mounted in the housing and operably connected to the latch;

an inner assembly comprising an inside handle, an inside spindle coupled to the inside handle to turn therewith, and an inner supporting plate to which the inside spindle is securely mounted;

an outer assembly comprising an outside handle, an outside spindle coupled to the outside handle to turn therewith, an outer supporting plate to which the outside spindle is securely mounted, and two mounting posts extending from the outer supporting plate to the inner supporting plate and each including a screw hole, the outside spindle comprising a square tube extending through the wheel for retracting the latch;

a protective sleeve comprising a circumferential wall having a first open end and a second open end and delimiting a longitudinal through-hole extending between the first open end and the second open end, with the circumferential wall having a constant thickness between the first and second open ends and around a circumference thereof, with the circumferential wall comprising two diametrically opposed longitudinal slots each extending from the second open end towards but spaced from the first open end, with the two diametrically opposed longitudinal slots each including first and second side edges extending from the second open end and toward but spaced from the first open end and a terminal edge extending between the first and second side edges and located intermediate the first and second open ends, with the first and second side edges and the terminal edge defining a perimeter delimiting the longitudinal slot, with the two diametrically opposed longitudinal slots forming two diametrically opposed shielding skirts for shielding the housing that extends into the protective sleeve through one of the longitudinal slots, with the circumferential wall further comprising a tab extending from the perimeter delimiting each said longitudinal slot and spaced from the first open end and the second open end and into the longitudinal through-hole of the protective sleeve, with each said tab bent from the circumferential wall at the terminal edge of the perimeter delimiting each said longitudinal slot, with each said tab having a thickness equal to the constant thickness, with each said tab including a through-hole through which an associated one of the mounting posts extends; and two fasteners extending through the inside supporting plate into the screw holes of the mounting posts to connect the inner and outer supporting plates together.

9. The lock as claimed in claim 8, with the circumferential wall of the protective sleeve being adapted to be fittingly received in a mounting hole of a door to which the lock is mounted.

10. The lock as claimed in claim 8, with the protective sleeve having a longitudinal length between the first and second open ends slightly smaller than that of a mounting hole of a door to which the lock is mounted.

* * * * *